US005852997A

United States Patent [19]

Vanderpoel

[11] Patent Number: 5,852,997

[45] Date of Patent: Dec. 29, 1998

[54] COMMON RAIL INJECTOR

[75] Inventor: Richard E. Vanderpoel, Bloomfield, Conn.

[73] Assignee: Stanadyne Automotive Corp., Windsor, Conn.

[21] Appl. No.: 859,158

[22] Filed: May 20, 1997

[51] Int. Cl.[6] ..... F02M 37/00

[52] U.S. Cl. ..... 123/446; 123/300; 123/456

[58] Field of Search ..... 123/446, 456, 123/300, 299, 447

[56] References Cited

U.S. PATENT DOCUMENTS

| | | | |
|---|---|---|---|
| 4,541,385 | 9/1985 | Eheim | 123/446 |
| 4,628,881 | 12/1986 | Beck | 123/446 |
| 5,325,834 | 7/1994 | Ballheimer | 123/446 |
| 5,413,076 | 5/1995 | Koenigswieser | 123/446 |
| 5,575,253 | 11/1996 | Lambert | 123/300 |
| 5,622,152 | 4/1997 | Ishida | 123/446 |
| 5,687,693 | 11/1997 | Chen | 123/446 |
| 5,697,341 | 12/1997 | Ausman | 123/446 |
| 5,697,342 | 12/1997 | Anderson | 123/446 |

*Primary Examiner*—Carl S. Miller
*Attorney, Agent, or Firm*—Alix, Yale & Ristas, LLP

[57] ABSTRACT

An injector for a common rail fuel injection system employs a solenoid operated valve configuration which functions to control the amount of filling by regulating the start of filling and the end of filling between the injection events. In some embodiments, a three-way solenoid valve is employed. The start of injection is controlled by a control piston. An intensifier piston is employed to increase the injection pressure. A pilot piston assembly may also be employed to regulate the shape of the injection.

23 Claims, 7 Drawing Sheets

COMMON RAIL INJECTOR

BACKGROUND OF THE INVENTION

This invention relates generally to injectors employed in fuel injection systems for internal combustion engines. More particularly, this invention relates to injectors employed in common rail type fuel injection systems.

In common rail injection systems, multiple injectors are connected to a source of pressurized fuel which is maintained at a common pressure by an accumulator. The common rail pressure is modified to control a valve for injecting pressurized fuel charges through the injector into the engine cylinders. A number of injector configurations have been advanced for common rail injection systems.

One type of common rail injector controls the fuel quantity injected through the injector orifice by starting and stopping the high pressure fuel stream. This is typically accomplished by a solenoid. The solenoid response time must be extremely fast, typically on the order of 200 microseconds or less. Consequently, the solenoid must be relatively sophisticated to ensure repeatability and insensitivity to pressure variations.

Another type of injector is an accumulator injector. The accumulator injector is operated on a principle wherein the injector is filled for a relatively long duration. When a pre-established pressure is achieved, a solenoid valve is activated to allow fuel to be injected into the engine cylinder. One of the deficiencies commonly exhibited by accumulator injectors is that the rate shape characteristics of the injection can be undesirable. In addition, for accumulator injectors, the opening pressure is interrelated to the quantity of fuel injected. The accumulator injector, however, does not require a high performance solenoid.

Other injectors which have been advanced employ a hydraulic valve control which is more readily adaptable to implementing a pilot injection. These hydraulic valve control devices result in a relatively high return flow to the fuel injection system and may involve relatively complex control valve configurations. Some injectors have employed intensifiers to intensify the pressure within the nozzle. Such injectors allow for a lower rail pressure but produce a relatively high return flow and have limited pilot potential and relatively high actuator response requirements.

Reliability of injectors for common rail systems is extremely important since injector failure has the potential to destroy the internal combustion engine. Typically, the injectors connect to a rail having pressures of 20,000 psi or more. These injectors are typically operated with solenoid controls. A stuck valve, broken tip or a malfunctioning of the electronics or the driver for the solenoid valve can result in a sufficient quantity of fuel being delivered to the cylinder to cause engine failure. Operational compensation for structural and mechanical failures is highly problematical since the time between detection of a problem and the time when corrective action is required may be extremely short or nonexistent. In accordance with general design principles, simpler injector configurations may reduce the failure rate for the injector but represent a tradeoff in performance requirements.

The present invention is designed to overcome some of the noted deficiencies of prior injectors to provide improved injection control which does not require a high performance solenoid to obtain suitable operation in a common rail fuel injection system.

SUMMARY OF THE INVENTION

Briefly stated, the invention in a preferred form is a fuel injector for a common rail fuel injection system. The injector may incorporate any of a number of solenoid operated control valve configurations. The injector comprises an injector body having an injection orifice, an interior nozzle chamber and an interior valve seat. An injector valve is mounted in the body and engageable with the seat to prevent fluid communication through the injection orifice. During an injection event, the injector valve axially lifts from the seat for injecting pressurized fuel through the orifice.

A control piston is axially displaceable in a control chamber. A pump piston coupled to the control piston is also axially displaceable in a pump chamber. A nozzle conduit connects the pump chamber and the nozzle chamber. Pressurized fuel supplied to the injector is received at a rail inlet. A control valve assembly which comprises a control valve is disposed in fluid communication relationship between the rail inlet and the control and pump chambers. The control valve selectively controls the supply of pressured fuel to the pump chamber and the control chamber. Fuel is supplied to the pump chamber between injection events, and the fuel quantity is selectively controlled. The fuel pressure in the control chamber is also selectively controlled to start the injection so that the injector valve is displaced by pressurized fuel in the nozzle chamber to thereby inject the pressured fuel through the injection orifice.

An intensifier unit may also be employed. The intensifier unit is responsive to pressure supplied at the rail inlet and includes an intensifier chamber and an intensifier piston engageable with the control piston. The pressure in the pump chamber during the injection pump stroke is greater than the rail pressure at the rail inlet. The pump piston is displaced to define the injection pump stroke by opening the control valve to vent pressure from the control chamber. The injector valve may be biased to the engaged position by hydraulic pressure, and the injector valve is displaceable from the seat when pressure in the nozzle chamber exceeds the biasing pressure of the injector valve. In one embodiment, a pilot valve assembly comprises a piston which lifts to implement a pilot injection.

In one embodiment, the control valve has a first position wherein pressure in the control chamber is vented and a second position wherein the control chamber is filled with pressurized fuel. In another embodiment, the control valve may have a three-way position wherein in the first position pressure in the control chamber is vented, in the second position the control chamber and pump chamber are filled with pressurized fuel and in the third position communication of fuel to the pump chamber is terminated. Preferably a solenoid operates the control valve. An electronic control system controls the operation of the solenoid.

A check valve may be disposed between the control valve and the pump chamber. In one embodiment, the control valve is disposed in a control valve chamber, and a trim valve adjusts the flow rate of the fuel supplied to the control valve chamber. The control piston, intensifier piston and pump piston are axially displaced substantially simultaneously to start the fuel injection event.

An object of the invention is to provide a new and improved injector for a common rail fuel injection system.

Another object of the invention is to provide a new and improved common rail injector which operates in a highly reliable manner and has an efficient, cost-effective construction.

A further object of the invention is to provide a new and improved common rail injector which is capable of controlling the fuel injection in a precise and highly reliable manner.

Other objects and advantages of the invention will become apparent from the drawings and the specification.

DETAILED DESCRIPTION OF THE PREFERRED EMBODIMENT

Figure 1:
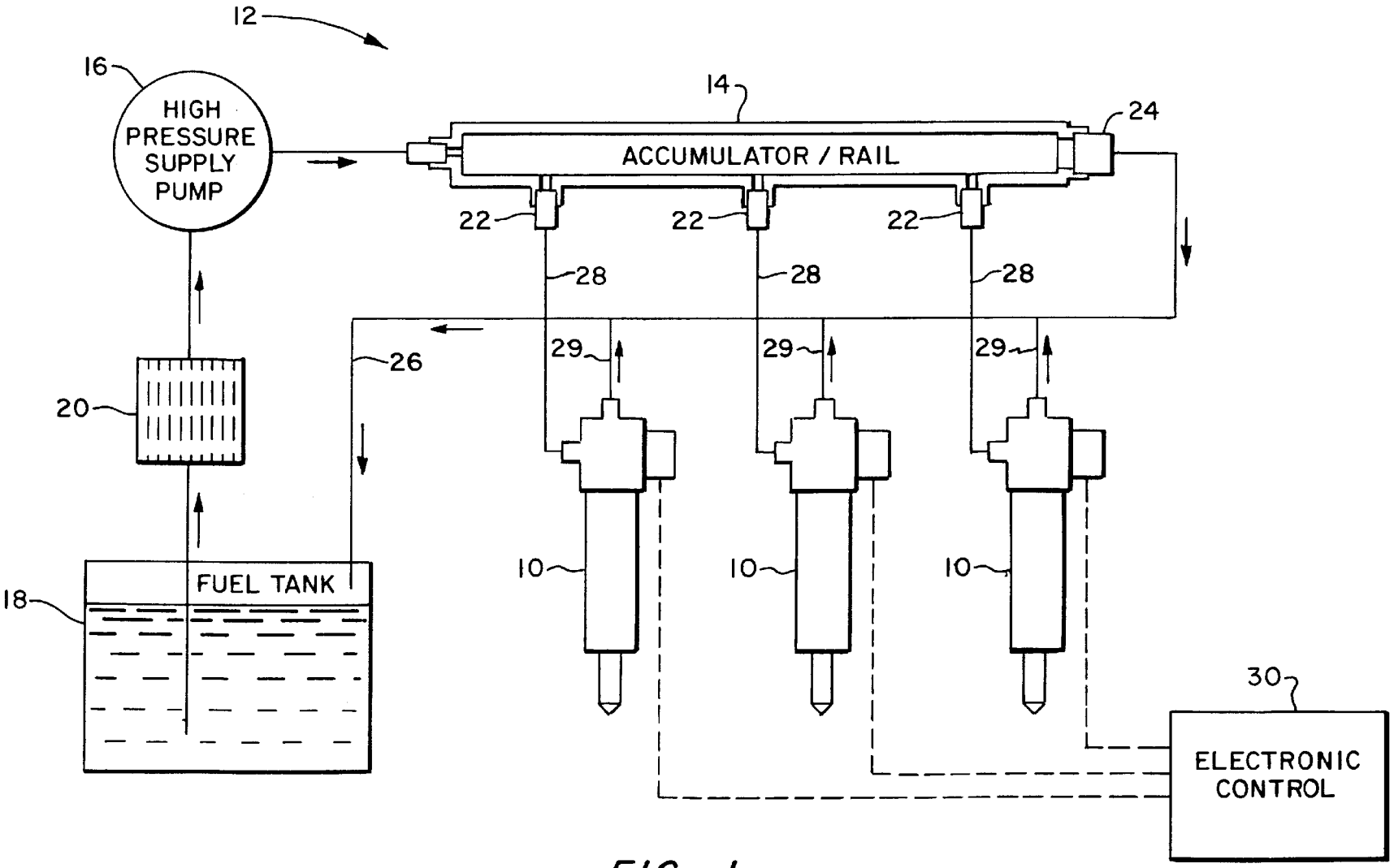
FIG. 1 is a schematic view of a common rail system employing an injector in accordance with the present invention.

With reference to the drawings, wherein like numerals represent like parts throughout the several figures, a common rail injector 10 is illustrated in conjunction with a common rail fuel injection system designated generally by the numeral 12. The injectors 10 function to inject pressurized charges of fuel into the cylinders of an internal combustion engine (not illustrated) for sequential combustion therein.

The common rail system employs a high pressure rail 14 which acts as an accumulator. A high pressure supply pump 16 connects with the fuel tank 18 via a fuel filter 20 for pressurizing fuel supplied to the accumulator. The accumulator includes a pressure regulator 24 which connects via line 26 for returning fuel to the tank 18. Each of the injectors connects via a fitting 22. A rail line 28 provides fluid communication between the accumulator and each injector. A return line 29 connects each injector to the return line 26. An electronic control 30 controls the operation of a solenoid associated with each injector to thereby control the operation of the corresponding injector 10.

Figure 2:
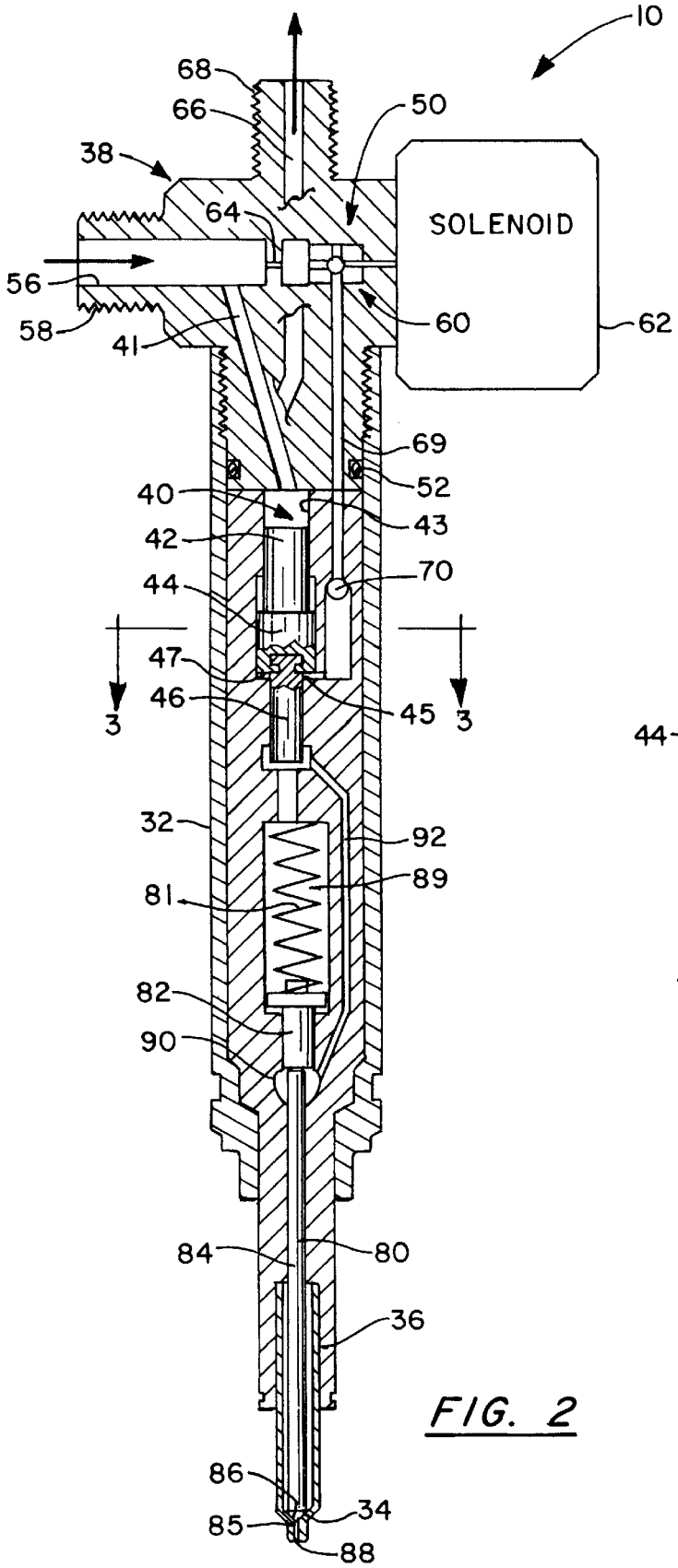
FIG. 2 is a sectional view, partly in schematic, of a common rail injector in accordance with the present invention.

With reference to FIG. 2, the common rail injector 10 comprises a tubular nozzle body 32 having a nozzle tip 34. The nozzle body houses a nozzle valve unit 36 and a piston assembly 40 and receives a control valve assembly 50, as will be further described below. The upper inlet end of the nozzle body includes a header 38 which houses the control valve assembly 50 and defines various passageways for external and internal fuel communication. The injector header 38 is preferably threaded to an interior upper end of a tubular element of the nozzle body and sealed by an O-ring 52.

As will be described in detail below, the piston assembly 40 stores the fuel to be injected and provides any intensifier function. The intensifier ratio may be one, greater than one or less than one. The control valves direct the flow of fuel to the piston assembly 40 and may comprise one or multiple stages. The first stage is usually directly controlled by a solenoid. A second stage may be driven by rail pressure or an intermediate pressure.

The header includes a transverse inlet bore 56 which directly communicates with the rail line for receiving fuel at the common rail pressure maintained by the accumulator. A threaded surface 58 surrounds the outer end of the inlet to receive a fitting to secure the high pressure connection with the rail line 28. A first stage, three-way valve 60 is controlled by a solenoid 62. Trim orifice 64 connects inlet bore 56 with valve 60. A threaded surface 68 surrounds the return bore for receiving a fitting to connect with the return line 29. The valve 60 also implements selective communication between the inlet bore 56 and an axial conduit 69 which supplies rail pressure to a second stage valve 70. The second stage valve 70 controls the piston assembly 40 by filling and spilling fuel, as will be described in detail below. The valve 60 may also be configured to close fluid communication with the rail line and the return line.

The piston assembly 40 includes an intensifier piston 42, a control piston 44 and a pump piston 46 coupled to the control piston 44. A diagonal passage 41 communicates directly with the top of an intensifier chamber 43 above the intensifier piston. The control piston reciprocates in a control chamber 45 which communicates via the second stage valve 70 and the first stage valve 60 with the rail line. A pump chamber 47 disposed below the pump piston 46 communicates with the axial conduit 92.

The nozzle valve unit can be a conventional nozzle valve configuration or it can be configured for a specific engine. As illustrated, the nozzle valve unit 36 comprises an elongated valve 80 having an enlarged head 82 and a stem 84 which is slidably received by an inwardly protruding fitting. The stem 84 terminates in a tip 85. The tip 85 engages an interior conical seat 86 in the nozzle. A spring 81 above the head biases the valve to a closed position against the seat to prevent fluid from flowing through one or more orifices 88 at the tip of the nozzle. Hydraulic pressure in chamber 89 above the head may be used to assist in the valve closure. Rail pressure can be applied to the nozzle valve spring chamber 89 to make the nozzle opening pressure variable.

A valve chamber 90 surrounds an underside portion of the nozzle head 82. The chamber communicates via a passage 92 with the pump chamber 47. A fluid passage extends to the nozzle valve tip to provide fluid communication to the interior lower portion of the nozzle.

Figure 3:
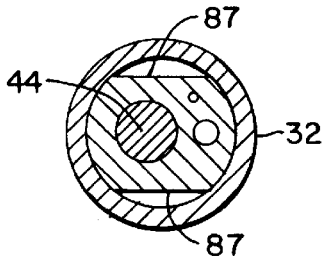
FIG. 3 is a cross-sectional view of the injector of FIG. 2 taken along the line 3—3 thereof.

The diameters of the pistons of the piston assembly 40 may be selected to provide for an intensifier piston function. In one embodiment, the intensifier piston 42 has a diameter of 6.4 millimeters, the control piston 44 has a diameter of 8.0 millimeters and the pump piston 46 has a diameter of 4.5 millimeters. During filling, the piston assembly has a slight force imbalance and lifts slowly while being controlled by the relatively large trim orifice. When the position of pistons 42, 44 and 46 reaches a pre-established height, the pressure is vented by the solenoid valve 50 to produce a large unbalanced force on the intensifier assembly. The pistons of the piston assembly move rapidly in a coordinated pump stroke to force intensified pressurized fluid in the pump chamber 47 to the nozzle chamber 90. The increased pressure in the nozzle chamber forces the valve 80 to lift from its valve seat to inject pressurized fuel through the nozzle orifice 88 into the cylinder of the engine. The pump plunger has a spill port 49 which ensures a sharp end of the pumping stroke. Flats 87 are formed on the cylindrical components surrounding pistons 42, 44 and 46 to form a fuel return flow path to return fuel to the tank. (See FIG. 3.) It should be noted that the pressures required to produce movement of the piston assembly are almost the same. A relatively large trim orifice produces the pressure difference so that there are no large pressure drops and very little energy is dissipated and relatively little waste heat is generated.

Figure 9:
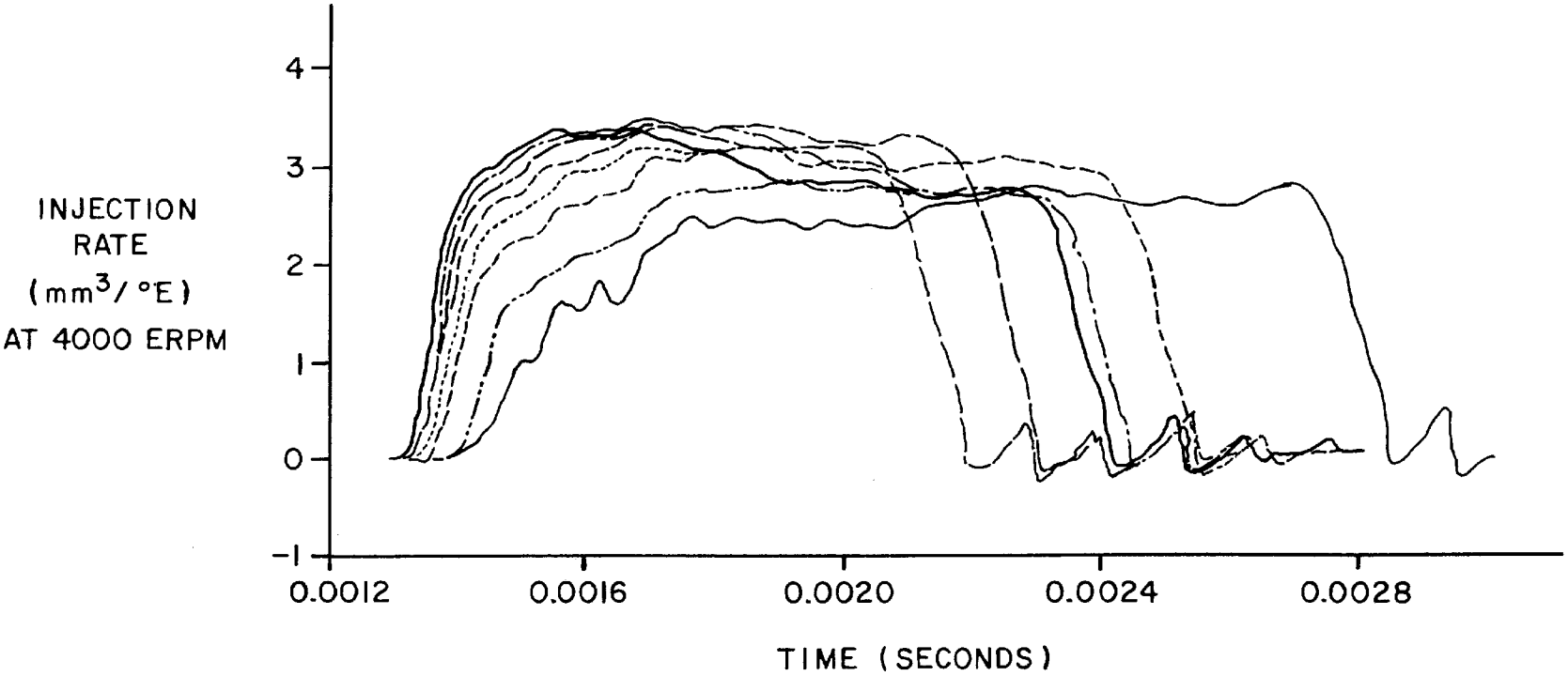
FIG. 9 is a representative graph illustrating the injection rate over time for the injector of FIG. 2.

The rate shape of a representative injection for one embodiment of injector 10 is illustrated in FIG. 9. The graph shows the rate of injection at 4,000 equivalent rpm as a function of the time in seconds after the initial opening of valve 50 for various diameters of rail inlet bore 56 at a constant length of 6.0 cm. The length and diameter of inlet bore 56 have an effect on the initial injection rate.

Figure 4:
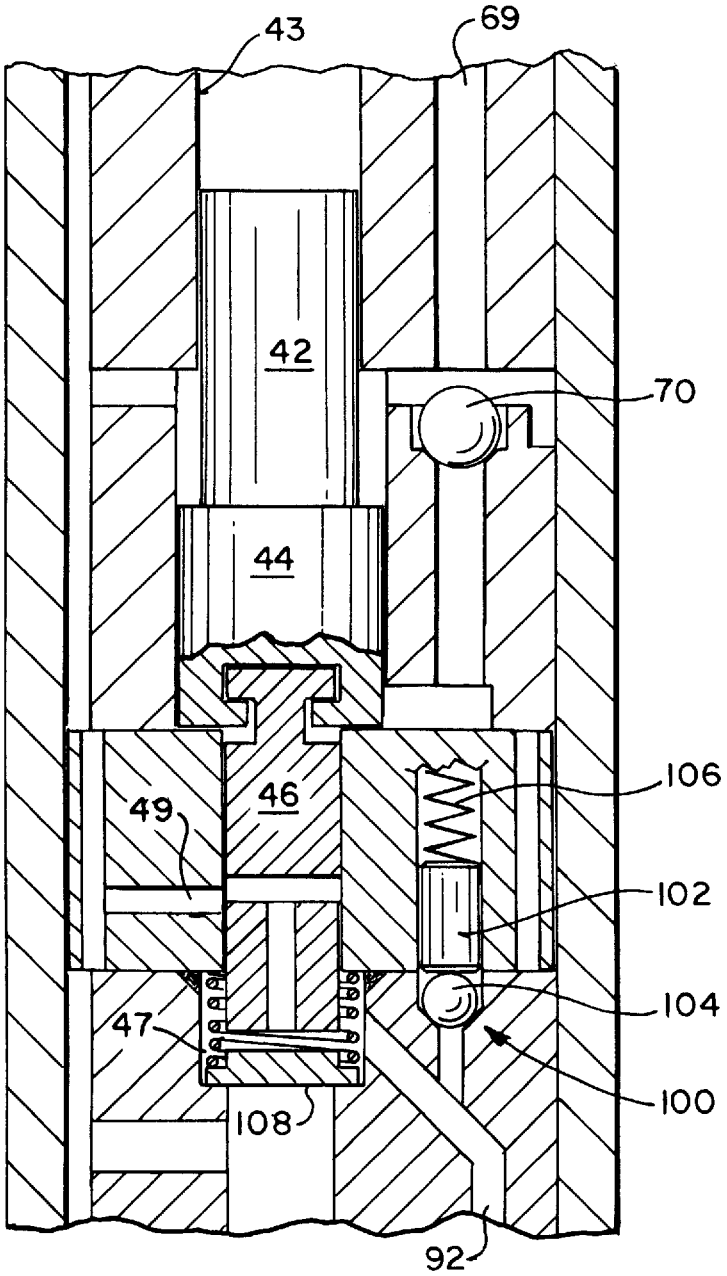
FIG. 4 is an enlarged fragmentary sectional view of a modified form of the injector of FIG. 2 incorporating a pilot control therein.

With reference to FIG. 4, a pilot control assembly 100 can also be mounted within the nozzle body. The pilot control assembly employs a pilot piston 102 which controls a ball valve 104. A spring 106 biases the valve to a closed position which prevents fluid communication through a bleed passage which leads from passage 92. The opening pressure of the ball valve defined by spring 106 is greater than the nozzle opening pressure. A check valve 108 is disposed at the bottom of the pump chamber. After the start of injection, the pressure will rise to a level which causes the ball to lift from its seat. The injection pressure which is exerted against the larger diameter piston 102 will cause the piston to lift very rapidly. The rapid lifting will displace a fixed quantity of pressurized fuel from the fuel duct which will thus drop the pressure in chamber 90 and bias the needle valve 80 toward the closed position. However, the higher pumping rate will quickly re-establish the pressure, and the valve 80 will again open. The spill ending of the pump stroke via port 49 allows the pilot piston to reset without pumping the fuel out of the orifice 88 to thereby impose a pilot injection, such as illustrated in FIG. 10.

Figures 10A, 10B, 10C:
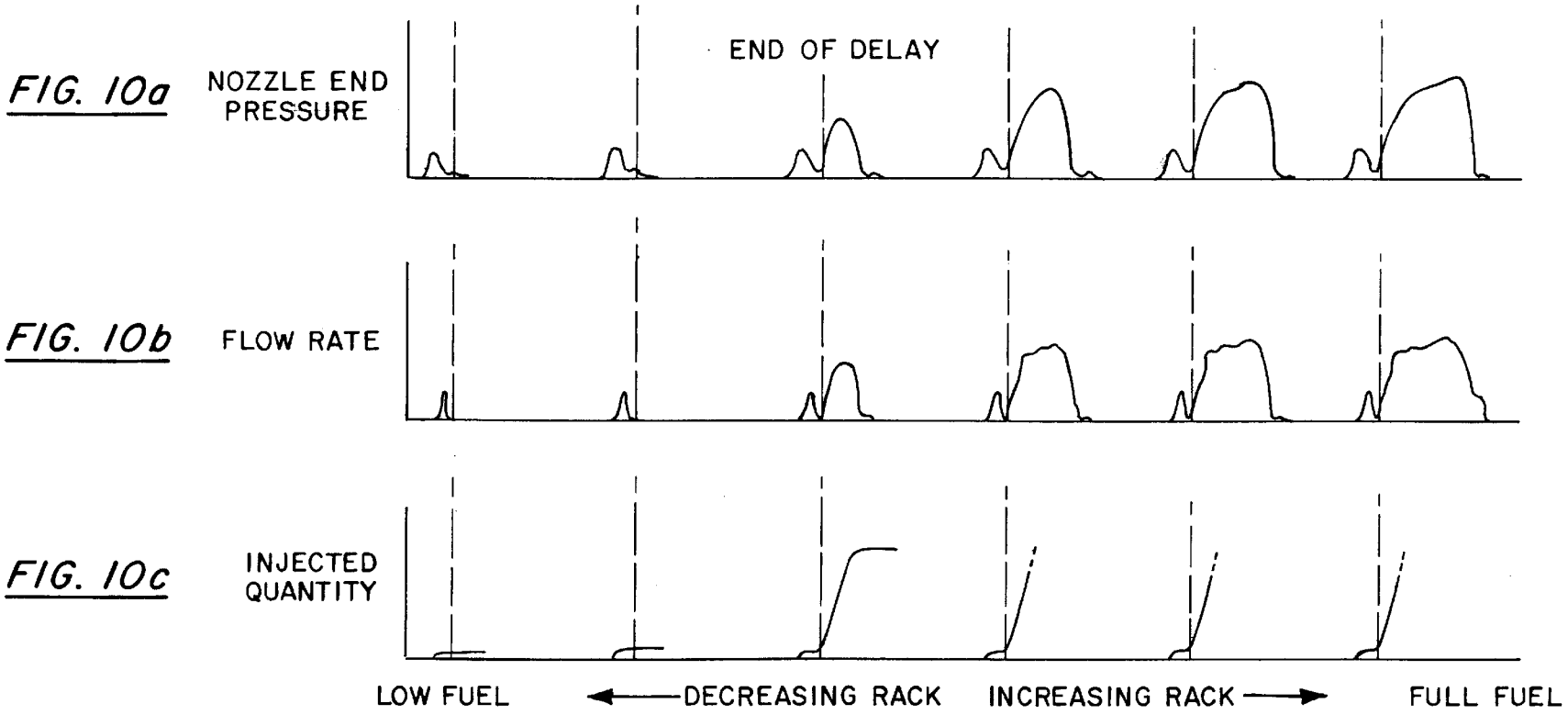
FIG. 10 is a graphical representation illustrating an injected fuel quantity for the injector of FIG. 4.

FIG. 10 illustrates representative pilot injection characteristics for a pilot control assembly for various fuel supply conditions for pump chamber 47. The graphical representations illustrate injected fuel quantity, flow rate and nozzle end pressure through nozzle 88.

A number of additional embodiments of the common rail injector, such as illustrated in FIGS. 5–8, are possible depending on the sophistication and requirements of the operating characteristics and the complexity of the nozzle construction. Each of the embodiments controls the quantity of fuel injection by controlling the fill time between injection events, e.g. the lifting of pistons 42, 44 and 46. The embodiments employ solenoid operated valves to control the fill time. Pressure intensifiers having an efficient construction and reliable operation are also advantageously incorporated into the injector.

Figure 5:
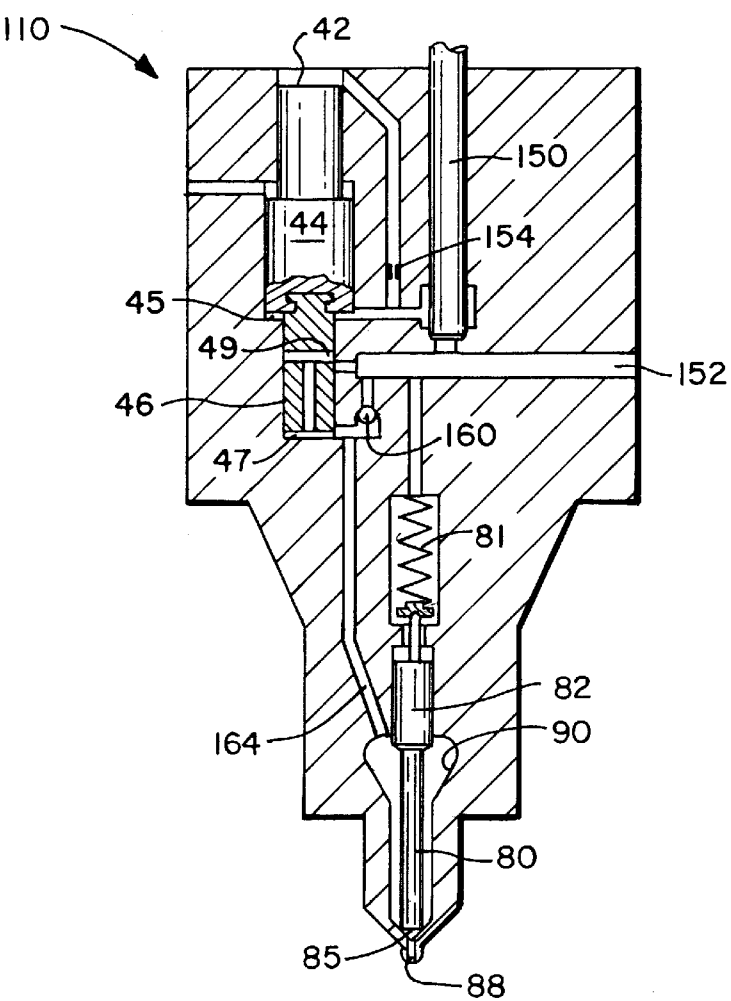
FIG. 5 is a schematic view of a third embodiment of a common rail injector illustrating a single stage, one-way valve configuration.

With reference to FIG. 5, an injector which incorporates a single stage, one-way valve configuration is designated generally by the numeral 110. The operation is governed by the status of a one-way solenoid control valve 150. At a time after the last injection, the valve 150 is open which thereby vents the control chamber 45 via vent passage 152. Some of the rail fuel is lost through the control orifice 154. The intensifier piston 42, control piston 44 and pump piston 46 are displaced to the extreme bottom position of their strokes. When the control valve 150 closes, the flow fills the volume in the control chamber 45 via orifice 154. Low pressure is applied to the pump chamber 47 at the bottom of the pump piston through the check valve 160. The intensifier piston 42, control piston 44 and pump piston 46 start to lift relatively slowly.

When it is time for the next injection event, valve 150 reopens pursuant to a command from the electronic control 30. The pressure in the control chamber 45 below the control piston therefore drops, and the intensifier piston, control piston and pump piston are displaced downwardly in a very rapid fashion. The volume of fuel in the pump chamber 47 below the pump piston is forced via passage 164 into the nozzle chamber 90 which lifts the nozzle valve 80 to inject pressurized fuel through orifice 88. The injection ends when the spill port 49 comes into alignment or when the control piston 44 hits its stop. For injector 110, the injected fuel quantity is controlled by the amount of time available for filling the control chamber 45. For maximum fuel quantity, filling starts soon after the last injection. For very small fuel quantity, filling starts just before the start of the next injection. The filling is precisely controlled by the solenoid control valve 150.

Figure 6:
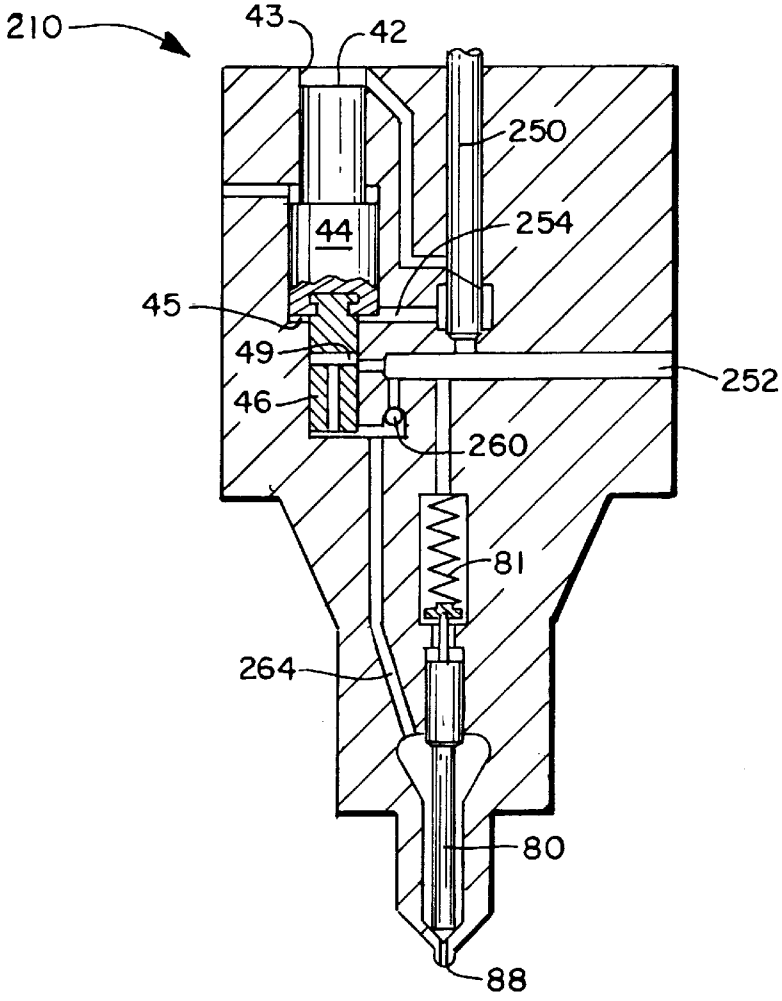
FIG. 6 is a schematic view of a fourth embodiment of a common rail injector illustrating a single stage, three-way valve configuration.

With reference to FIG. 6, a common rail injector implementing a single stage, three-way valve configuration is shown generally as injector 210. For injector 210, sometime after the last injection, valve 250 is open thereby venting the control chamber 45 via passage 252. The intensifier piston 42, control piston 44 and pump piston 46 are displaced to the bottom of their strokes. The solenoid control activates valve 250 to close, thereby supplying fuel via passage 254 to the control chamber 45 below the control piston 44. Low pressure fuel is supplied to the pump chamber 47 below the pump piston through the check valve 260. A passage 264 also communicates to the nozzle chamber 90.

Upon closing of valve 250, the intensifier piston 42, control piston 44 and pump piston 46 start to lift in a relatively slow manner. A command is transmitted to the solenoid to open valve 250 and vent the pressure via vent passage 252. The pressure in the control chamber 45 decreases. The intensifier piston, control piston and pump piston travel downwardly in a very rapid fashion to force the volume of fuel below the pump piston from the pump chamber 47 into the nozzle chamber 90. The pressure in chamber 90 forces the nozzle valve 80 to lift and inject pressurized fuel through orifice 88. The fuel injection ends when the spill port 49 comes into alignment or the control piston 44 hits its stop. For this injector 210, the fuel quantity is again controlled by the amount of time available for filling. For example, for maximum fuel quantity, filling starts very soon after the last injection. For very small fuel quantity, filling starts just before the start of the next injection.

Figure 7:
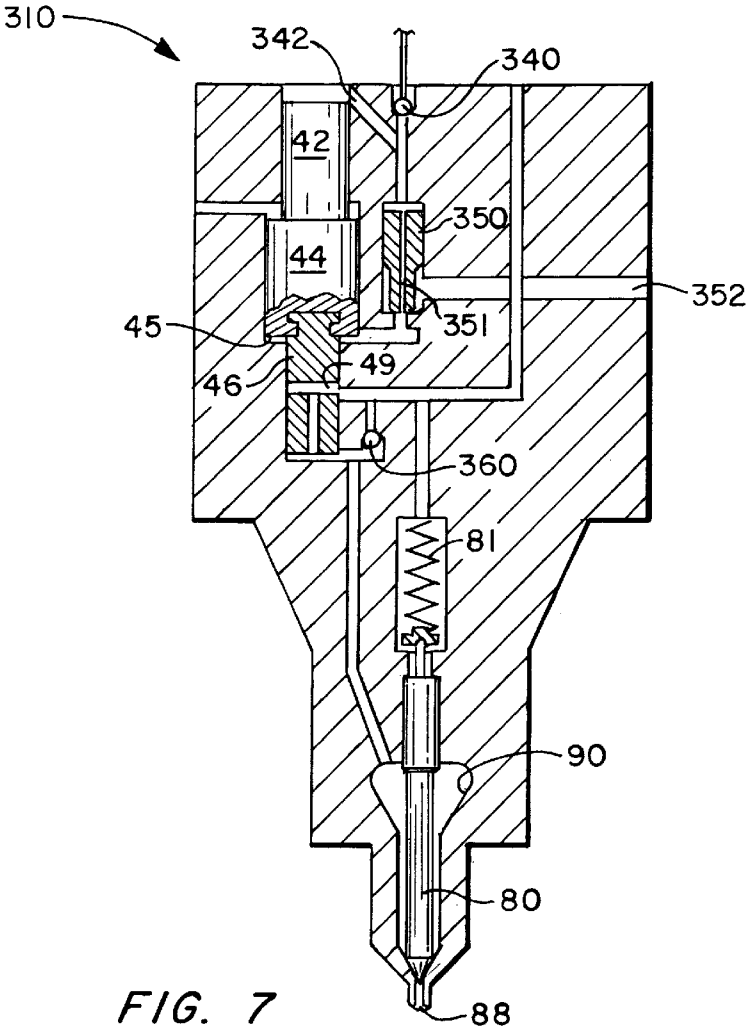
FIG. 7 is a schematic view of a fifth embodiment of a common rail injector illustrating a two stage, one-way valve configuration.

With reference to FIG. 7, a common rail injector implementing a two stage, one-way injection is designated by the numeral 310. After an injection event, valve 340 is in the open position. Some of the rail pressure flows through orifice 342 out to return through valve 340. Valve 350 is open venting the bottom of the control chamber 45 through vent passage 352. The intensifier piston, control piston and pump piston are at the bottom of their pump strokes.

A command from the electronic control 30 closes valve 340 to thereby allow pressure to build up on the back side of valve 350. Valve 350 closes. The pressure is applied to the bottom of the control piston through the passage 351 in the valve. Low pressure is supplied to the pump chamber 47 at the bottom of the pump piston 46 through the check valve 360. The intensifier piston, control piston and pump piston start to lift in a slow fashion. When it is time for the next injection event, valve 340 is activated to the open position. The pressure above valve 350 drops, valve 350 opens and the pressure below the control piston 44 therefore drops. The intensifier piston, control piston and pump piston travel downwardly in very rapid fashion, and the volume of fuel below the pump piston is forced into the nozzle chamber 90 to lift the valve 80 and inject pressurized fuel through the nozzle orifice 88. The injection ends when the spill port 49 comes into alignment or the control piston 44 hits the stop. The fuel quantity is again controlled by the amount of time available for filling.

Figure 8:
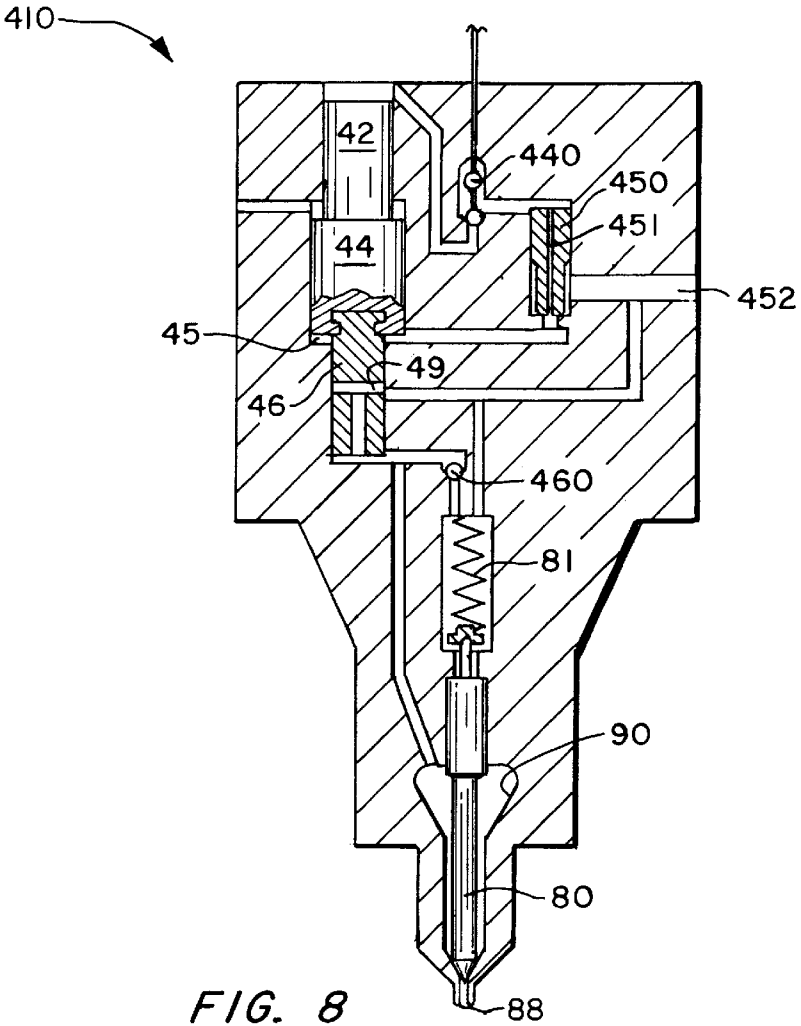
FIG. 8 is a schematic view of a sixth embodiment of a common rail injector illustrating a two stage, three-way valve configuration.

With reference to FIG. 8, a common rail injector implementing a two stage, three-way valve configuration is designated by the numeral 410. Starting at sometime after the last injection event, the solenoid valve 440 is open to low pressure. Valve 450 is open, thereby venting the control chamber 45 via vent passage 452. The intensifier piston, control piston and pump piston are at the bottom of their strokes. Valve 440 then switches to a second position to supply pressure to the back side of valve 450. Valve 450 then closes. Pressure is supplied to the control chamber 45 below the control piston through the passage 451 in the valve 450. Low pressure is also supplied to the pump chamber below the pump piston through the check valve 460. The intensifier piston, control piston and pump piston start to lift in a slow fashion. When it is time for the next injection event, valve 440 switches to a third position. The pressure above valve 450 decreases, valve 450 moves and the pressure below the control piston in the piston chamber decreases. The intensifier piston, control piston and pump piston travel downwardly in very rapid fashion. The volume of fuel below the pump piston is then injected until the spill port 49 opens or the control piston hits its stop. Again, the fuel quantity is controlled by the amount of time available for filling.

It will be appreciated that for each of the foregoing common rail injectors, the nozzle is filled between injections. The end of the filling is essentially the start of the next injection, but the filling period is significantly longer than the injection period—typically, approximately ten times as much longer. Because of the foregoing characteristics, the fuel quantity is much less sensitive to the valve timing compared to other nozzles that use the control valve to start and stop the injection directly. In addition, the solenoid opens and closes the control valve when conditions are more quiescent. If the intensifier piston 42 and the pump piston 46 are substantially the same diameter, the injection pressure is equal to the rail pressure. However, if the intensifier piston is larger than the pump piston, the injection pressure will be higher than rail pressure.

The common rail injectors as described are operable so that the injected fuel is introduced at a relatively slow rate and in an accurate fashion between injection events and then is injected rapidly and at a high pressure during injection. The pistons are substantially balanced during the filling process. Consequently, there is a small pressure drop and small energy loss as a result of the filling process. In addition, the injector configuration allows for the incorporation of a trim orifice of relatively large diameter. Such a trim orifice configuration is relatively easy to manufacture and is not sensitive to small amounts of wear during operation.

For common rail injector configurations as described, the rail pressure does not act on the valve tip between injection events. Consequently, even if the valve tip were leaky, such a condition would not result in the engine being greatly overfueled. For the common rail injectors, the maximum fuel delivery is limited by the piston stroke. Thus, no failure mode can cause a single injection to exceed the maximum allowable fuel quantity designed into the piston assembly. Repeated or continuous injection commands cannot produce unlimited fuel quantities because the control piston must be refilled for each injection event.

While a number of embodiments have been set forth for purposes of describing the invention, the foregoing descriptions are not a limitation of the invention. Accordingly, various modifications, adaptations and alternatives may also occur to one skilled in the art without departing from the spirit and the scope of the present invention.

What is claimed is:

1. A fuel injector for a common rail injection system comprising:

an injector body having axially spaced inlet and injection portions, said injection portion defining an injection orifice, a nozzle chamber and an interior valve seat, said inlet portion comprising a rail inlet for receiving pressurized fuel supplied to said injector;

an injector valve mounted in said body and engageable with said seat to prevent fuel communication through said injection orifice and during an injection event axially displaceable from said seat for injecting pressurized fuel through said orifice;

a control unit comprising a control chamber and a control piston axially displaceable in said control chamber;

a pump unit comprising a pump chamber and a pump piston axially displaceable in said pump chamber;

a nozzle conduit connecting said pump chamber and said nozzle chamber;

a control valve assembly comprising a control valve to provide selective fuel communication between said rail inlet and said control and pump chambers for controlling the supply of pressurized fuel in said pump chamber and said control chamber, said pump piston being displaced for the injection of pressurized fuel by opening said control valve to vent pressure from said control chamber, so that fuel is controllably supplied to said pump chamber between injection events and the fuel in said control chamber is selectively controlled to start an injection whereby said injector valve is displaced by pressurized fuel in said nozzle chamber to inject pressurized fuel through said injection orifice.

2. The injector of claim 1 further comprising an intensifier unit responsive to pressure supplied at said rail inlet and comprising an intensifier chamber and an intensifier piston.

3. The injector of claim 2 wherein the pressure in the pump chamber upon displacement of the pump piston during an injection pump stroke is proportional to the rail pressure at said rail inlet.

4. The injector of claim 1 wherein said pump piston is displaced for the injection of pressurized fuel by opening said control valve to vent pressure from said control chamber.

5. The injector of claim 1 wherein said injector valve is biased to the engaged position with said seat and said injector valve is displaceable from said seat when pressure in said nozzle chamber exceeds the biasing pressure of the injector valve.

6. The injector of claim 1 further comprising a pilot valve assembly comprising a piston which is displaced to implement a pilot injection during said injection event.

7. The injector of claim 1 wherein said control valve has a first position wherein pressure in said control chamber is vented and a second position wherein the control chamber is filled with pressurized fuel.

8. The injector of claim 1 wherein said control valve comprises a three-way valve having a first position wherein pressure in said control chamber is vented, a second position wherein the control chamber and pump chamber are supplied with pressured fuel and a third position wherein communication of fuel to said pump chamber is terminated.

9. The injector of claim 1 further comprising a solenoid for controlling the position of said control valve.

10. The injector of claim 9 further comprising an electronic control system for controlling the operation of said solenoid.

11. The injector of claim 1 further comprising a check valve disposed between said control valve and said pump chamber.

12. The injector of claim 1 wherein said control valve is disposed in a control valve chamber and further comprising a trim valve for selectively controlling the rate of fuel supplied to said control valve chamber.

13. The injector of claim 2 wherein said control piston, intensifier piston and pump piston are axially displaced substantially simultaneously to start the fuel injection event.

14. A fuel injector for a common rail injection system comprising:

an injector body having axially spaced inlet and injection portions, said injection portion defining an injection orifice, a nozzle chamber and a valve seat, said inlet portion comprising a rail inlet for receiving pressurized fuel supplied to said injector;

an injector valve mounted in said body and engageable with said seat to prevent fuel communication through said injection orifice and during an injection event displaceable from said seat for injecting pressurized fuel through said orifice;

a control unit disposed in said injector body comprising a control chamber and a control piston displaceable in said control chamber;

a pump unit comprising a pump chamber and a pump piston coupled to said control piston displaceable in said pump chamber to define an injection pump stroke;

a control valve assembly comprising at least one control valve disposed in fluid communication relationship between said rail inlet and said control and pump chambers for selectively controlling the supply of pressurized fuel in said pump chamber and said control chamber, so that fuel is controllably supplied to said pump chamber between injection events and the fuel pressure in said control chamber is vented by said control valve to start an injection whereby said injector valve is displaced by pressurized fuel produced by said pump stroke to inject pressurized fuel through said injection orifice.

15. The injector of claim 14 further comprising a third unit responsive to pressure supplied at said rail inlet and comprising a third chamber and a third piston engageable with said control piston.

16. The injector of claim 15 wherein the pressure in the pump chamber during the injection pump stroke is greater than the rail pressure at said rail inlet.

17. The injector of claim 2 wherein said pump piston is displaced for the injection of pressurized fuel by opening said control valve to vent pressure from said control chamber.

18. The injector of claim 14 further comprising a solenoid for controlling the position of one of said at least one control valve.

19. A fuel injector for a common rail injection system comprising:

an injector body having a rail inlet for receiving pressurized fuel supplied to said injector and an injection portion, said injection portion defining an injection orifice, a nozzle chamber and an interior valve seat;

an injector valve mounted in said body and engageable with said seat to prevent fuel communication through said injection orifice and during an injection event displaceable from said seat for injecting pressurized fuel through said orifice;

a control unit comprising a control chamber and a control piston displaceable in said control chamber;

a pump unit comprising a pump chamber and a pump piston displaceable in said pump chamber;

nozzle conduit means for fluidly connecting said pump chamber and said nozzle chamber;

a control valve assembly comprising a control valve which selectively controls fluid communication between said rail inlet and said control and pump chambers for selectively controlling the supply of pressurized fuel in said pump chamber and said control chamber, a solenoid for operating said control valve;

so that fuel is controllably supplied to said pump chamber between injection events and the pressure of fuel in said control chamber is selectively vented to start the injection whereby said injector valve is displaced by pressurized fuel in said nozzle chamber to inject pressurized fuel through said injection orifice.

20. The injector of claim 19 further comprising a third unit responsive to pressure supplied at said rail inlet and comprising a third chamber and a third piston, said pump piston being coupled to said control piston, said control piston and said third pistons being engageable.

21. A fuel injector for a common rail injection system comprising:

an injector body having axially spaced inlet and injection portions, said injection portion defining an injection orifice, a nozzle chamber and an interior valve seat, said inlet portion comprising a rail inlet for receiving pressurized fuel supplied to said injector;

an injector valve mounted in said body and engageable with said seat to prevent fuel communication through said injection orifice and during an injection event axially displaceable from said seat for injecting pressurized fuel through said orifice;

a control unit comprising a control chamber and a control piston axially displaceable in said control chamber;

a pump unit comprising a pump chamber and a pump piston axially displaceable in said pump chamber;

a nozzle conduit connecting said pump chamber and said nozzle chamber;

a control valve assembly comprising a control valve to provide selective fuel communication between said rail inlet and said control and pump chambers for controlling the supply of pressurized fuel in said pump chamber and said control chamber, said control valve comprising a three-way valve having a first position wherein pressure in said control chamber is vented, a second position wherein the control chamber and pump chamber is supplied with pressurized fuel and a third position wherein communication of fuel to said pump chamber is terminated, so that fuel is controllably supplied to said pump chamber between injection events and the fuel in said control chamber is selectively controlled to start an injection whereby said injector valve is displaced by pressurized fuel in said nozzle chamber to inject pressurized fuel through said injection orifice.

22. A fuel injector for a common rail injection system comprising:

an injector body having axially spaced inlet and injection portions, said injection portion defining an injection orifice, a nozzle chamber and an interior valve seat, said inlet portion comprising a rail inlet for receiving pressurized fuel supplied to said injector;

an injector valve mounted in said body and engageable with said seat to prevent fuel communication through said injection orifice and during an injection event axially displaceable from said seat for injecting pressurized fuel through said orifice;

a control unit comprising a control chamber and a control piston axially displaceable in said control chamber;

a pump unit comprising a pump chamber and a pump piston axially displaceable in said pump chamber;

a nozzle conduit connecting said pump chamber and said nozzle chamber;

a control valve assembly comprising a control valve chamber and a control valve to provide selective fuel communication between said rail inlet and said control and pump chambers for controlling the supply of pressurized fuel in said pump chamber and said control chamber; and a trim valve for selectively controlling the rate of fuel supplied to said control valve chamber, so that fuel is controllably supplied to said pump chamber between injection events and the fuel in said control chamber is selectively controlled to start an injection whereby said injector valve is displaced by pressurized fuel in said nozzle chamber to inject pressurized fuel through said injection orifice.

23. A fuel injector for a common rail injection system comprising:

an injector body having axially spaced inlet and injection portions, said injection portion defining an injection orifice, a nozzle chamber and a valve seat, said inlet portion comprising a rail inlet for receiving pressurized fuel supplied to said injector;

an injector valve mounted in said body and engageable with said seat to prevent fuel communication through said injection orifice and during an injection event displaceable from said seat for injecting pressurized fuel through said orifice;

a control unit disposed in said injector body comprising a control chamber and a control piston displaceable in said control chamber;

a pump unit comprising a pump chamber and a pump piston coupled to said control piston displaceable in said pump chamber to define an injection pump stroke;

a third unit responsive to pressure supplied at said rail inlet comprising a third chamber and a third piston engageable with said control piston;

a control valve assembly comprising at least one control valve disposed in fluid communication relationship between said rail inlet and said control and pump chambers for selectively controlling the supply of pressurized fuel in said pump chamber and said control chamber, said pump piston being displaced for the injection of pressurized fuel by opening said control valve to vent pressurized fuel from said control chamber, so that fuel is controllably supplied to said pump chamber between injection events and the fuel pressure in said control chamber is selectively controlled to start an injection whereby said injector valve is displaced by pressurized fuel produced by said pump stroke to inject pressurized fuel through said injection orifice.

* * * * *

UNITED STATES PATENT AND TRADEMARK OFFICE

CERTIFICATE OF CORRECTION

PATENT NO. : 5,852,997
APPLICATION NO. : 08/859158
DATED : December 29, 1998
INVENTOR(S) : Vanderpoel It is certified that error appears in the above-identified patent and that said Letters Patent is hereby corrected as shown below:

Column 8:

Line 54, delete “claim 1” and substitute --claim 21--.

Column 9:

Line 61, delete “claim 2” and substitute --claim 22--.

Signed and Sealed this

Twenty-seventh Day of May, 2008

JON W. DUDAS
*Director of the United States Patent and Trademark Office*